US009630299B1

(12) United States Patent
Lien

(10) Patent No.: US 9,630,299 B1
(45) Date of Patent: Apr. 25, 2017

(54) MASTER JAW ASSEMBLY

(71) Applicant: Lien Master Jaw, LLC, Brooklyn Park, MN (US)

(72) Inventor: Hue Van Lien, Blaine, MN (US)

(73) Assignee: Lien Master Jaw, LLC, Brooklyn Park, MN (US)

( * ) Notice: Subject to any disclaimer, the term of this patent is extended or adjusted under 35 U.S.C. 154(b) by 0 days.

(21) Appl. No.: 14/309,255

(22) Filed: Jun. 19, 2014

Related U.S. Application Data

(63) Continuation-in-part of application No. 14/090,956, filed on Nov. 26, 2013, now abandoned.

(51) Int. Cl.
*B25B 1/16* (2006.01)
*B25B 1/24* (2006.01)
*B25B 5/16* (2006.01)

(52) U.S. Cl.
CPC ..... *B25B 1/2452* (2013.01); *B25B 1/2405* (2013.01); *B25B 5/163* (2013.01)

(58) Field of Classification Search
CPC B25B 1/24; B25B 1/2405; B25B 5/16; B25B 5/163
See application file for complete search history.

(56) References Cited

U.S. PATENT DOCUMENTS 530,733 A 12/1894 Tower
1,488,559 A 4/1924 Simokaitis
3,341,190 A 9/1967 Adamson
3,565,417 A * 2/1971 Degle ..... B25B 1/2473 269/136
3,685,817 A 8/1972 Worthington
4,251,066 A * 2/1981 Bowling ..... B25B 1/2452 269/283
4,437,654 A 3/1984 Chiappetti
4,462,581 A 7/1984 Mitani
4,798,371 A 1/1989 Wallisser
4,861,010 A 8/1989 Neil
4,898,371 A 2/1990 Mills et al.
4,960,270 A 10/1990 Fitzpatrick
5,065,990 A 11/1991 Durfee
5,150,888 A * 9/1992 Durfee ..... B25B 1/24 269/254 CS (Continued)

*Primary Examiner* — Joseph J Hail
*Assistant Examiner* — Tyrone V Hall, Jr.
(74) *Attorney, Agent, or Firm* — Moss & Barnett; Glen E. Schumann

(57) ABSTRACT

A master jaw assembly for an engineering vise is provided by the invention. The master jaw assembly comprises a master jaw having a groove formed in its side wall face, and a detachable jaw having a dovetailed rib projecting from its side wall face so that the soft jaw may be attached to the master jaw by frontally inserting the dovetailed rib into the groove with minimal loosening of the hold-down nuts in the master jaw. A special hold-down nut used to secure the dovetailed rib of the detachable jaw inside the groove of the master jaw has a substantially longer base edge compared with its top edge to provide increased securing force. The master jaw also features an adjustable reference stop plate attached to the end of the master jaw that may be moved to its engagement position when needed to engage the edge of or interior niche in the detachable jaw to ensure that the detachable jaw is attached to the master jaw in precisely accurate alignment on a repeatable basis.

28 Claims, 12 Drawing Sheets

(56) References Cited

U.S. PATENT DOCUMENTS

| | | | | |
|---|---|---|---|---|
| 5,649,694 | A | 7/1997 | Buck | |
| 6,022,010 | A | 2/2000 | Bernstein | |
| 6,957,809 | B1 * | 10/2005 | Ferrara | B25B 1/2405 269/282 |
| 6,971,643 | B1 | 12/2005 | Garrison | |
| 2008/0255623 | A1 | 10/2008 | Steiner | |
| 2010/0219573 | A1 * | 9/2010 | O'Rell | B23Q 1/42 269/246 |
| 2012/0256362 | A1 * | 10/2012 | Ehnstrom | B25B 1/2452 269/282 |

* cited by examiner

MASTER JAW ASSEMBLY

CROSS-REFERENCE TO RELATED APPLICATION

This application is a continuation-in-part of U.S. Ser. No. 14/090,956 filed on Nov. 26, 2013, which is hereby incorporated by reference.

FIELD OF THE INVENTION

This invention relates generally to vise devices for holding or clamping work pieces to allow work to be performed on them, and more specifically to master jaw assemblies for the quick removal and reattachment in repeatably positioned alignment of a soft jaw with respect to the master jaw.

BACKGROUND OF THE INVENTION

A vise is a mechanical screw apparatus used to hold or clamp a work piece in place while work is performed on it with tools such as saws, drills, mills, screwdrivers, etc. A vise typically has a fixed jaw that remains stationary, while a moving jaw in parallel relationship to the fixed jaw is moved towards or away from the fixed jaw by means of a screw.

An engineer's vise is used in metal-working applications. It is made from case steel or malleable cast iron for strength. Its jaws may constitute separate pieces made from soft or hard metal, depending upon the nature of the work piece and work operation to be performed on it. Hard jaws featuring serrated or diamond teeth provide good gripping to hold the work piece in place. But, their hard surfaces applied under pressure by the operator to the work piece can deform or mar the surface of the work piece—particularly given the serrations or diamond teeth on the hard jaw, or over-tightening of the hard jaw by the operator. Thus, soft jaws made with a smooth face from a soft metal like aluminum or plastic or wood are typically used to hold more delicate work pieces. Soft jaws may also be provided in advance with specially pre-shaped contours for holding the specific exterior shape of the work piece.

Hard jaws and soft jaws can wear out over time to the point that they no longer securely hold a work piece, and need to be replaced. Moreover, because soft jaws may have their working surfaces that engage the work piece specifically pre-shaped to match the contour of the work piece, they will not accommodate other work pieces having a different shape. This means that the soft jaw needs to be changed to a differently shaped soft jaw if the operator is switching between different types of work pieces during a work day.

Many different methods are known in the industry for attaching the soft jaw to the fixed jaw or movable jaw portion of the vise. For example, the soft jaw can be bolted securely to the fixed jaw or movable jaw. But, this bolted arrangement can make it difficult and time-consuming for an operator to switch between different types of soft jaws.

U.S. Pat. No. 530,733 issued to Tower in 1894 shows a different securement means by which a steel faced hard jaw and the movable jaw or fixed jaw have cooperating shaped surfaces that allow the two jaw portions to be attached to one another to form a mortise joint. A spring-loaded key contained inside a channel in the vise body engages the hard jaw to provide additional securement. However, the multiple ribs and recess of the mortise joint must be carefully milled into both the hard jaw and jaw portion of the vise so that the two pieces closely cooperate to form the mortise joint. Moreover, the mortise surface of the hard jaw must be carefully slid into engagement along the mortise surface of the vise body portion to join the two pieces, which makes their joinder a time-consuming affair requiring manual dexterity by the operator.

U.S. Pat. No. 3,341,190 issued to Adamson discloses a vise assembly in which supplemental jaws featuring an outwardly trapezoidally-shaped "V-guide" protrusion are bolted to the movable jaw and fixed portion of the vise. The hard jaw plates feature a mating slot having the same shape as the V-guide protrusion so that the hard jaw plate is slid into engagement with the supplemental plate from above. A locking member with a cam member provides additional securement means between the hard jaw plate and the supplemental plate.

U.S. Pat. No. 3,565,417 issued to Degle and U.S. Pat. No. 4,437,654 issued to Chiappetti show a different arrangement in which the interchangeable jaw member has a pair of L-shaped arms that engage mated slots in the vise support block when the jaw member is slid into engagement with the vise support block from above. This is a hard jaw with diamond-shaped grooves where the operator will tighten the vise around the hard work piece, so an additional locking cam member or spring loaded key is unnecessary for securing the interchangeable jaw member to the vise body support.

U.S. Pat. No. 3,685,817 issued to Worthington discloses a vise having a jaw member that pivots with respect to the vise body by means of pins on the vise body engaging slots formed in the jaw member. The two opposing jaw members on the closed vise pivot into engagement with a conically-shaped work piece.

U.S. Pat. No. 4,898,371 issued to Mills et al. discloses yet another arrangement in which the detachable jaw plates have formed within them T-shaped slots. Bolts having a T-shaped head extending from the vise body engage these slots as the detachable jaw plate is placed against the vise body and slide so that the T-shaped slots engage the corresponding T-shaped bolts. See also U.S. Pat. No. 6,971,643 issued to Garrison; U.S. Pat. No. 4,861,010 issued to Neil; U.S. Pat. No. 6,022,010 issued to Bernstein; and U.S. Pat. No. 4,960,270 issued to Fitzpatrick.

U.S. Pat. No. 4,798,371 issued to Wallisser illustrates a similar concept in which the detachable jaw features a T-shaped groove, while the vise body (movable jaw and fixed jaw) features a T-shaped rib protrusion that mates with the T-shaped groove. But once again, the detachable jaw must be slid along the vise body jaw from its end, so that frontal engagement of the detachable jaw with the vise body is impossible. This makes it more difficult to remove a jaw from the vise body and attach a new or replacement jaw. Pins and spring-loaded ball catches are additionally required by Wallisser for supplemental attachment of the detachable jaw to the vise body.

Two vise assemblies containing a dovetailed joint between the detachable jaw and the vise body are disclosed in U.S. Pat. No. 1,488,559 issued to Simokaitis and U.S. Pat. No. 5,649,694 issued to Buck. But, these references show a very close fit between the detachable jaw and the vise body along the dovetailed joint. This requires close milling of the parts and attachment of the detachable jaw from the end of the vise body. A crowded machine shop, however, may make this end loading of the detachable jaw to or from the vise body difficult or cumbersome where end access is impeded.

U.S. Pat. Nos. 5,065,990 and 5,150,888 both issued to Durfee disclose a vise where a cleat extending from a parallel positioning plate engages a slot formed in a removable jaw plate with a vertical bolt traveling through a base in the removable jaw plate into engagement with the cleat of the parallel positioning plate. These cleats and slots must closely match each other's shapes, and only end loading of the parallel positioning plate into engagement with the removable jaw plate is possible.

U.S. Published Patent Application 2012/0256362 filed by Ehnstrom discloses a quick-change vise jaw system in which a locking jaw is secured to the fixed or movable body of the vise by means of bolts. A soft jaw has a protruding dovetailed rib that fits into a slot in the face of the locking jaw. Several clamping nuts are raised or lowered by means of double-threaded bolts contained inside bores formed in the locking jaw so that the tapered bottom edge of the clamping nuts engage or disengage from the tapered edge of the dovetailed rib inserted inside the slot of the locking jaw.

The vise assembly of Ehnstrom does allow the soft jaw to be frontally attached to the locking jaw, instead of slid into engagement from the end. However, because of the relatively tight fit between the dovetailed rib and the groove of the Ehnstrom master jaw assembly, the clamping nuts must be substantially disengaged from contact with the dovetailed rib to provide the necessary clearance for frontal engagement or disengagement of the soft jaw from the locking jaw.

Another problem faced by users of vises is the challenge of positioning a work piece retained in the vise in proper alignment with a working tool. If a single work piece is placed in the vise to undergo work performed by a manually-operated tool like on a home work bench, then there is little difficulty because the user can manually adjust the position of the tool to properly perform the work on the work piece.

However, many manufacturers rely upon automated machine tools to perform repetitive operations on a work piece in an accurate manner. Such tools like drills, lathes, saws, milling machines, wood routers, and laser cutters are moved inside a computer numerical control turning center into a predetermined position and operated by means of computer-aided design ("CAD") and computer-aided manufacturing ("CAM") software programs that store a series of programmed commands for properly positioning and operating the tool. A number of different sizes of tools (e.g. drills, saws) or different types of tools may be contained in the CNC turning center to perform work upon a predetermined location on the work piece retained in a vise in direct response to those computer commands.

However, the efficiency of CNC-operated tools becomes quickly compromised if the work piece is not correctly positioned with respect to the fixed position of the tool defined by the computer commands. A master jaw assembly secured to the vise containing a soft jaw that is specifically contoured to hold the work piece in position provides a ready solution once the vise and its master jaw and soft jaw components are correctly positioned with respect to the computer-determined fixed position for the tool. A number of work pieces can then be serially inserted into the soft jaw to have the desired working tools perform their operations at predetermined locations on the work pieces in response to the computer commands.

But any manufacturing operation will inevitably need to switch between different jobs performed inside the CNC turning center. This will require the soft jaw to be detached from the master jaw and replaced with a differently-shaped soft jaw for the new job. This is the reason that soft jaws are used. But, if the user wishes to return to the former job order, then the former soft jaw not only must be installed in the master jaw, but also it must be installed in the precisely same position with respect to the master jaw, or else the work pieces will no longer properly line up with the fixed spatial position of the CNC-operated tools. If not properly aligned, the computer commands inputted into the CNC turning center must be changed in order to account for the new position of the soft jaw holding the work piece.

U.S. Pat. No. 4,898,371 issued to Mills et al. discloses a stopping plate that is screwed to the end of a fixed vise jaw member to assist with the orientation of a jaw blank attached to the face of the fixed vise jaw member by means of a cooperating cleat/T-shaped slot. But, this stopping plate cannot be easily moved into or out of position without installation or removal of a number of screws. U.S. Pat. No. 4,960,270 issued to Fitzpatrick discloses a stop mechanism that must be specially mounted to the top of the vise jaw by means of bolts. An adjustable alignment rod is retained in the stop mechanism by means of a set screw. However, this stop mechanism is also cumbersome to install and remove from the vise and only engages the work piece, itself, instead of a soft jaw to ensure proper alignment of the soft jaw with respect to a master jaw.

Therefore, providing a master jaw assembly in which a detachable jaw like a soft jaw or hard jaw can be frontally attached to the groove in the master jaw, and properly aligned with respect to the position of the master jaw for repetitive removal and attachment of the soft jaw or hard jaw would be very advantageous.

SUMMARY OF THE INVENTION

A master jaw assembly for an engineering vise is provided by the invention. The master jaw assembly comprises a master jaw having a groove formed in its side wall face, and a detachable jaw having a dovetailed rib projecting from its side wall face so that the soft jaw may be attached to the master jaw by frontally inserting the dovetailed rib into the groove with minimal loosening of hold-down nuts contained in the master jaw. Gap distances between the height of the dovetailed rib face and the opening face of the groove, and between the opening face and back wall of the groove enhance the ability to insert the dovetailed rib frontally into the groove, while providing good structural stability for the joinder of the detachable jaw to the master jaw. A special hold-down nut used to secure the dovetailed rib of the detachable jaw inside the groove of the master jaw preferably has a substantially longer base edge compared with its top edge to provide increased securing force. This hold-down nut may be readily moved inside the master jaw towards or away from engagement with the dovetailed rib of the detachable jaw by means of a rotatable or counter-rotatable threaded fastener such as a double-ended stud or a bolt in combination with a retaining ring.

The master jaw also features an adjustable reference stop plate attached to the end of the master jaw that may be moved to its engagement position when needed to engage the edge of or interior niche in the detachable jaw to ensure that the detachable jaw is attached to the master jaw in precisely accurate alignment on a repeatable basis. The adjustable reference stop plate can then easily be moved to its retracted position when it is not needed without any need to physically detach it from the master jaw.

The detachable jaw may be a hard jaw or a soft jaw, including a soft jaw that is specially contoured to the shape of a work piece to be held in the master jaw assembly. The master jaw assembly of the present invention is particularly beneficial when used in association with a computer numerical controlled-tool that must be properly aligned with the work piece retained in the detachable jaws.

DETAILED DESCRIPTION OF THE PREFERRED EMBODIMENT

A master jaw assembly for an engineering vise is provided by the invention. The master jaw assembly comprises a master jaw having a groove formed in its side wall face, and a detachable jaw having a dovetailed rib projecting from its side wall face so that the soft jaw may be attached to the master jaw by frontally inserting the dovetailed rib into the groove with minimal loosening of the hold-down nuts in the master jaw. The master jaw also features an adjustable reference stop plate attached to the end of the master jaw that may be moved to its engagement position when needed to engage the edge of or interior niche in the detachable jaw to ensure that the detachable jaw is attached to the master jaw in precisely accurate alignment on a repeatable basis. The adjustable reference stop plate can then easily be moved to its retracted position when it is not needed without any need to physically detach it from the master jaw. The detachable jaw may be a hard jaw or a soft jaw, including a soft jaw that is specially contoured to the shape of a work piece to be held in the master jaw assembly. The master jaw assembly of the present invention is particularly beneficial when used in association with a computer numerical controlled-tool that must be properly aligned with the work piece retained in the detachable jaws.

In the context of the present application, "machine tool" means a drill, saw, lathe, milling machine, wood router, laser cutter, plasma cutter, water jet cutter, surface grinder, cylindrical grinder, knife cutter, glass cutter, embroidery needle, sheet metal punch, wire bender, hot-wire foam cutter, or other tool that performs a work operation upon a work piece.

For purposes of the present invention, "work piece" means an object made from metal, wood, plastic, glass, fabric, foam, or other useful material that is in the process of manufacture to produce an end product.

For purposes of this application, "computer numeric control" or "CNC" means an automated system for a machine tool that operates the machine tool in response to commands that are programmed into a computer storage medium, particularly for determining which machine tool performs a working operation at what time point on which point of location on a work piece.

For purposes of the present invention, "detachable jaw" means a replaceable or substitutable jaw portion of a master jaw assembly that may be easily detached from engagement with the master jaw portion and replaced with a new hard jaw or soft jaw, or by a soft jaw having a different specially contoured surface for accommodating a work piece having a different shape, or of a different type of material.

Figure 1:
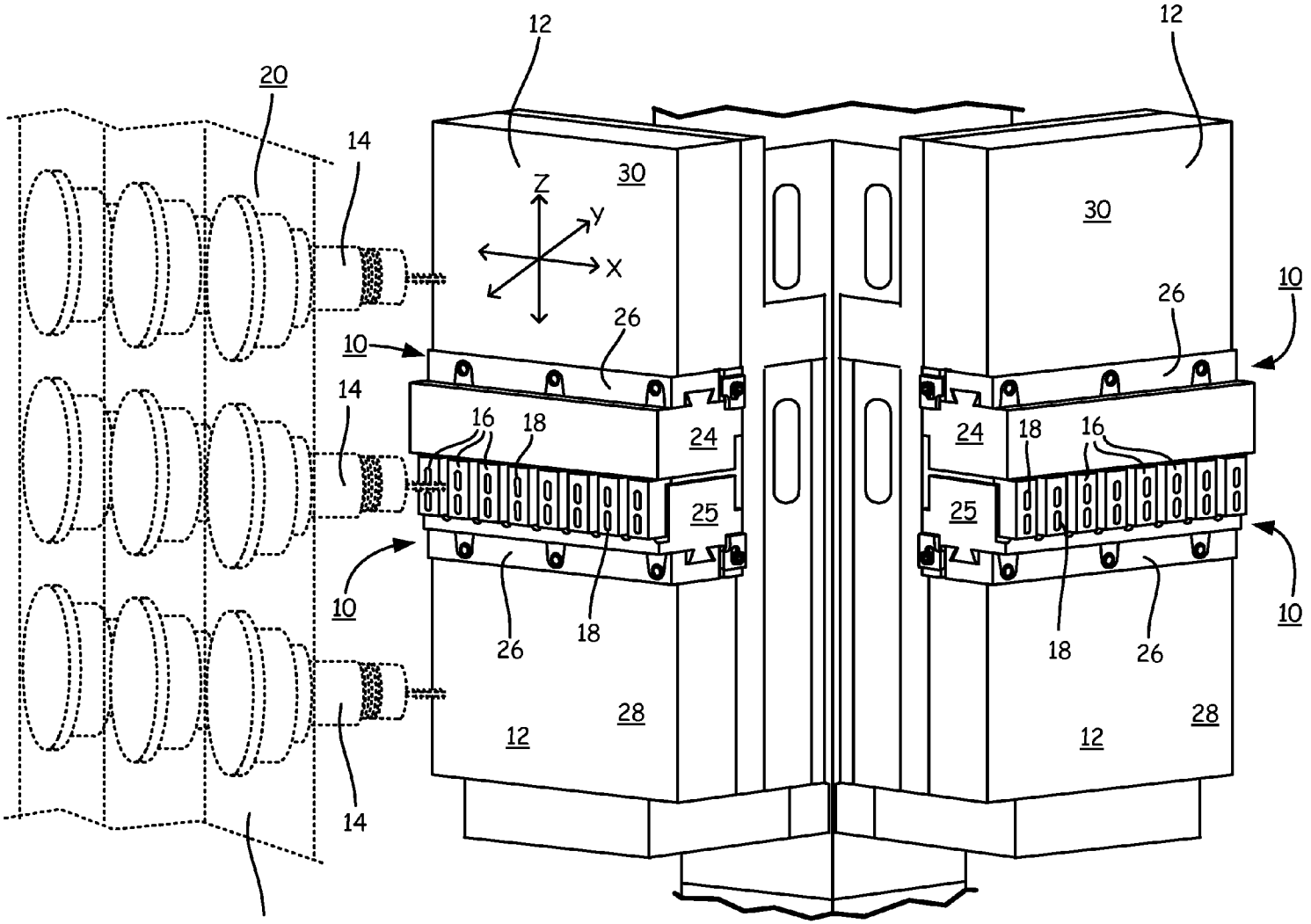
FIG. 1 is a perspective view of the master jaw assembly of the present invention retained within a vise and holding a number of work pieces in association with a computer numeric controlled series of machine tools.

The master jaw assembly 10 of the present invention held by an engineering vise 12 is shown in FIG. 1 in association with computer numeric control-operated machine tools 14. The machine tools 14 may comprise any of a number of useful tools for performing useful work on a work piece, including without limitation, drills, saws, lathes, milling machines, wood routers, laser cutters, plasma cutters, water jet cutters, surface grinders, cylindrical grinders, knife cutters, glass cutters, embroidery needles, sheet metal cutters or punches, wire benders, hot wire foam cutters, or any other tool that performs a useful work operation on the work piece. As shown in FIG. 1, the machine tools 14 may comprise a series of drill bits of different sized diameters, but it should be understood that the machine tools are not limited in this manner. Rather, an array of different tools, plurality of identical tools, or array of similar tools of different sizes may be provided so that a predetermined tool of predetermined size is selected to perform its work operation on the work piece 16.

While not shown in FIG. 1, the array of machine tool drills 14 are mounted to a spindle and operated by means of a sprocket assembly to position the preselected drill bit with respect to the work piece 16 along the X-axis, Y-axis, and Z-axis. In this case, the drill bit 14 is drilling a series of holes 18 into a metal block comprising the work piece 16. The work piece is not limited to a metal block, but rather may form any object made from any material suitable for the end-use application like metal, wood, plastic, glass, fabric, or foam of any appropriate size that needs to have a particular shape, aperture, or other useful feature imparted to it during a manufacturing process or series of processes to produce a desired end product.

While the spindle sprocket assembly for selecting the particular machine tool 14 and correctly positioning it along the X-axis, Y-axis, and Z-axis with respect to the work piece 16 may be operated by hand by means of a hand wheel or lever, the spindle more typically in a manufacturing operation is driven by motors through a series of step-down gears in order to provide highly accurate movement, or by direct-drive motors or servo motors. Open-loop or closed-loop controls are required in order to provide the accuracy, speed, and repeatability demanded. Instead of moving the machine tool 14 in the X-axis, Y-axis, and Z-axis, the vise 12 and master jaw assembly 10 holding the work piece 16 may be moved instead in the X-axis and Y-axis, while the spindle moves the machine tool 14 in the Z-axis.

Even more typically in modern manufacturing operations, this tool spindle is operated by means of a computer numerical control ("CNC") system that uses a series of commands preprogrammed into the hard drive or other storage medium of the CNC turning center 20 to select the correct machine tool 14 and correctly position it with respect to the work piece 16 at the predetermined time point. But, it is essential to the manufacturing operation that the master jaw assembly 10 hold the work piece 16 in correct spatial alignment (along the X-axis, Y-axis, and Z-axis) with the machine tool 14, or else the work operation will not be performed by the machine tool 14 upon the correct location on the work piece 16, or even miss the work piece altogether. This will require a corrected set of commands to be reprogrammed into the storage medium of the CNC turning center 20. Any high-throughput, continuous manufacturing operation requires proper alignment between the machine tool 14 and work piece 16.

Figure 2:
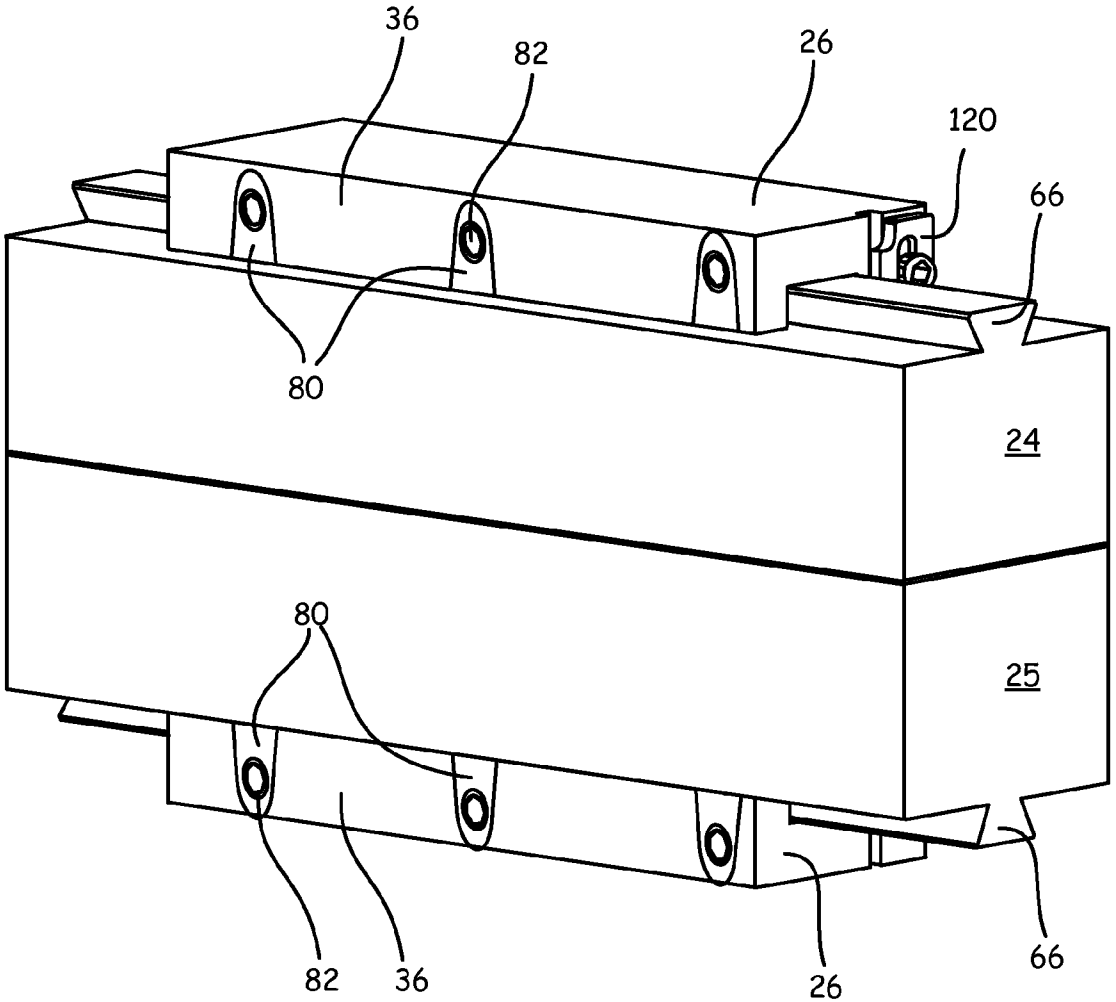
FIG. 2 is a perspective view of two detachable jaws attached to their respective master jaws without any work piece retained between the closed detachable jaws.

The master jaw assembly 10 of the present invention is shown more clearly in FIG. 2 without a work piece 16 retained in it. The master jaw assembly comprises a pair of detachable jaws 24 and 25 that in turn are attached to a pair of master jaws 26. The master jaws, in turn, are respectively attached to the fixed jaw portion 28 and movable jaw portion 30 of the vise so that when the movable jaw 30 is moved in the closing direction, its master jaw 26 and detachable jaw 24 attached thereto are likewise moved in the closing direction towards the detachable jaw 25 and master jaw 26 attached to the fixed jaw portion 28 until a work piece is secured between the opposing detachable jaws 24 and 25. Once the work is performed on the work piece to produce the intermediately processed or finished end product, the movable jaw portion 30 is moved in the opening direction to move the master jaw 26 and detachable jaw 24 away from the detachable jaw 25 and master jaw 26 attached to the fixed jaw portion of the vise, so that the work piece may be removed from the vise.

Figure 3:
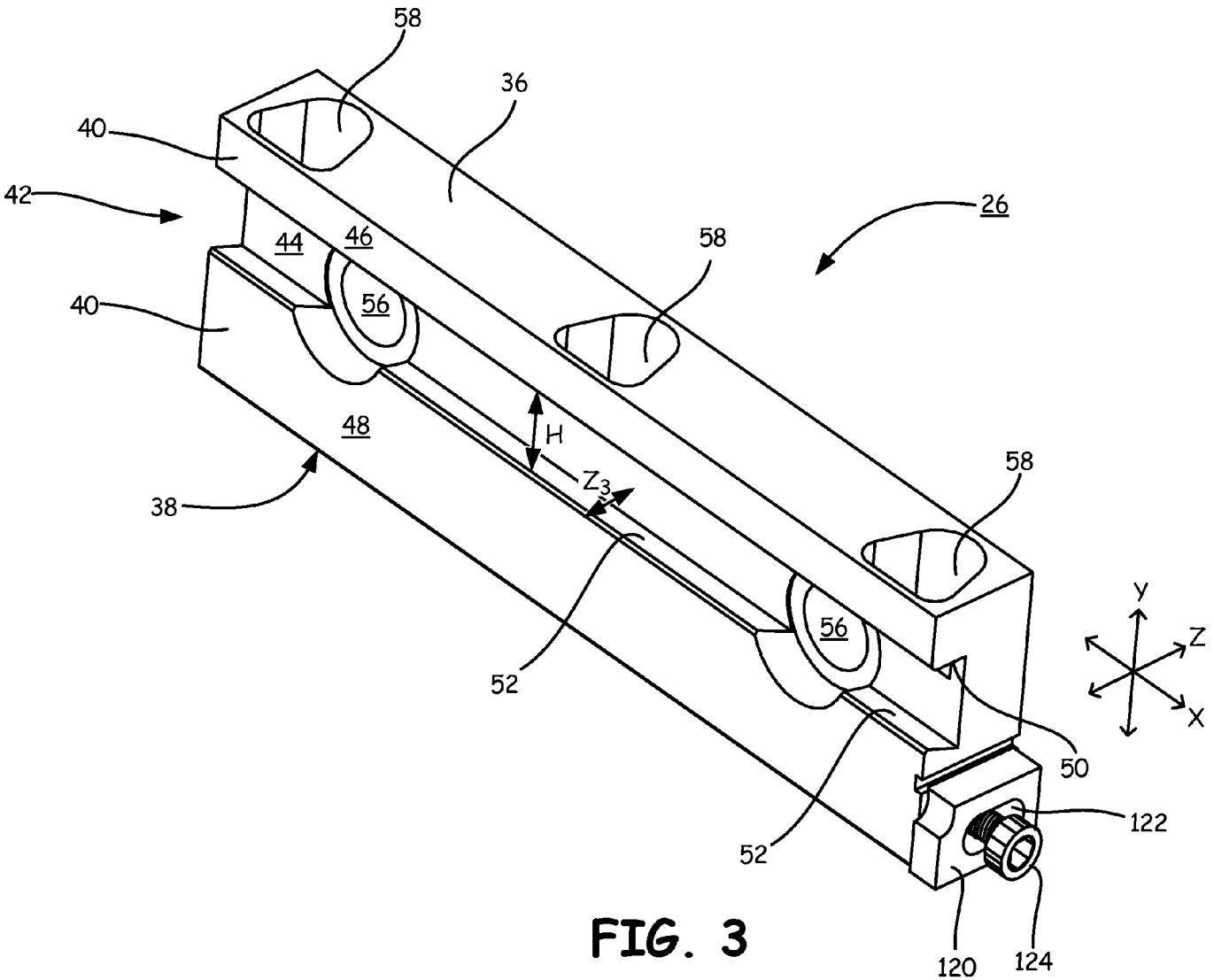
FIG. 3 is a perspective view of the master jaw.

The master jaw 26 is shown more clearly in FIG. 3. This master jaw is machined from a metal material like aluminum to precise dimensions. It comprises a top edge 36, a bottom edge 38, and an inner side wall 40. A groove 42 extends across the entire length of the inner side wall 40 along an X-axis between the top edge 36 and bottom edge 38. The groove 42 extends into the master jaw 26 along the Z-axis to define its depth $Z_3$ and along the Y-axis to define its height H. The groove 42 in turn has a base wall 44 defined between the first side portion 46 and second side portion 48 of the inner side wall 40. The first side portion 46 has a flat bottom face 50. The second side portion 48 has a tapered face 52 sloping inwardly and downwardly towards the base face 44.

As shown in FIG. 3, the master jaw 26 also includes at least two countersunk apertures 56 extending from the inner side wall 40 through the width of the master jaw. These holes 56 are for accommodating a suitable fastener like a flat head socket bolt (not shown) for attaching the master jaw 26 to the fixed jaw portion 28 or movable jaw portion 30 of the vise. The apertures 56 may be located anywhere on the face of the inner side wall 40, but they are preferably positioned along the base wall 44 inside groove 42 so that the heads of the socket bolts will not interfere with the orientation of detachable jaws 24 or 25 when they are attached to master jaw 26, as described below.

A plurality of nut holes 58 are cut into the top edge 36 of master jaw 26. They accommodate the hold-down nuts 80 in the master jaw 26 discussed below.

Figure 5:
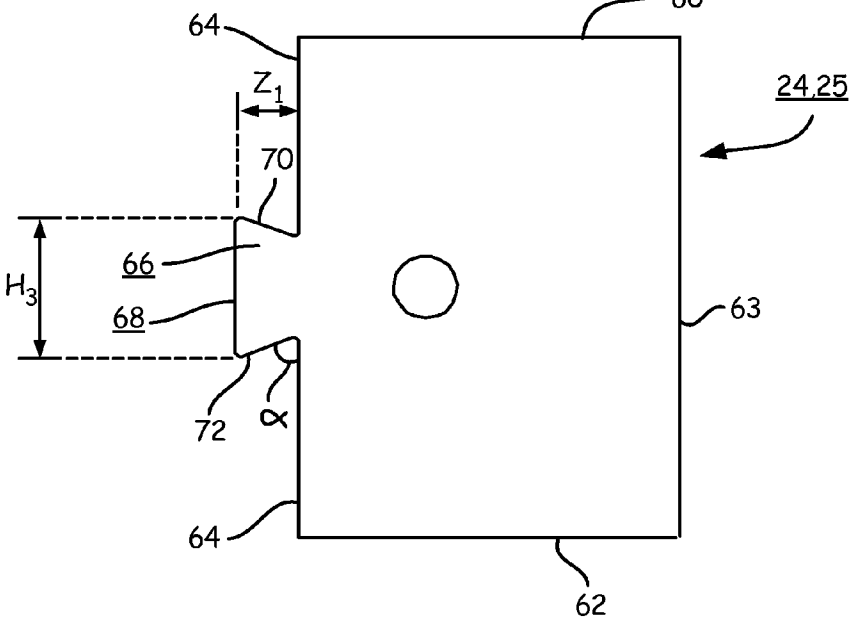
FIG. 5 is an end view of the detachable jaw of FIG. 2.
Figure 6:
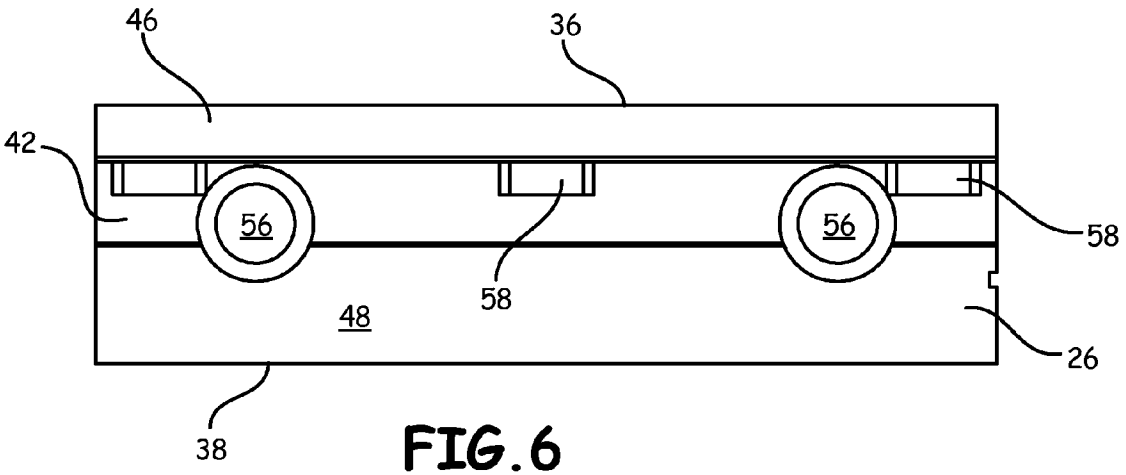
FIG. 6 is a side view of the master jaw of FIG. 3.
Figure 7:
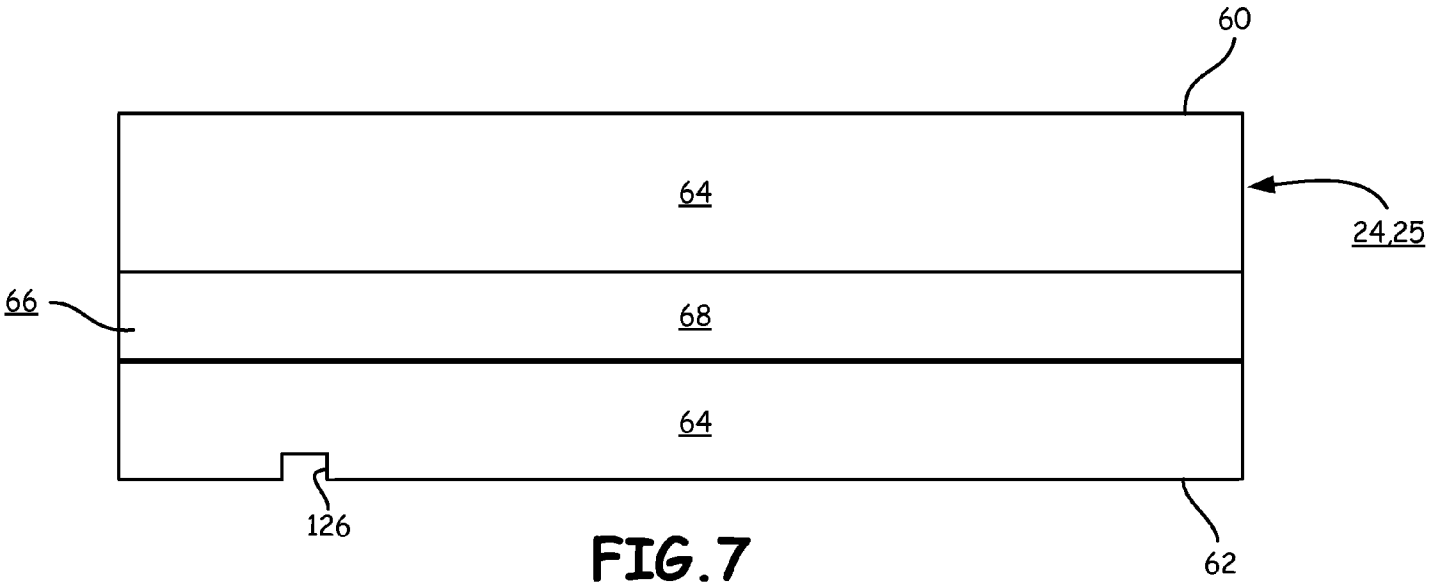
FIG. 7 is a side view of the detachable jaw of FIG. 2.
Figure 8:
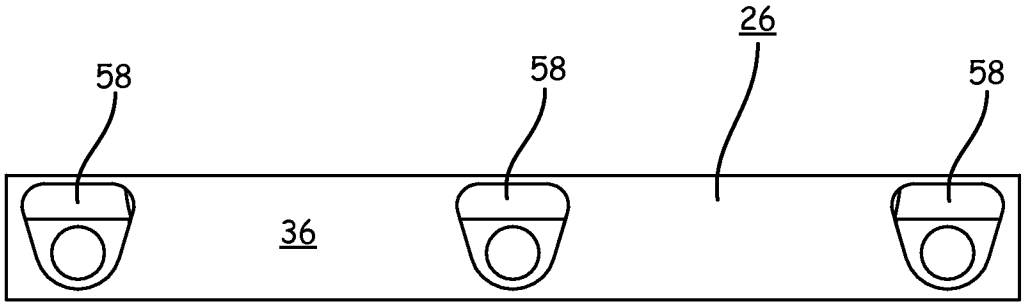
FIG. 8 is a plan view of the master jaw of FIG. 3.
Figure 9:
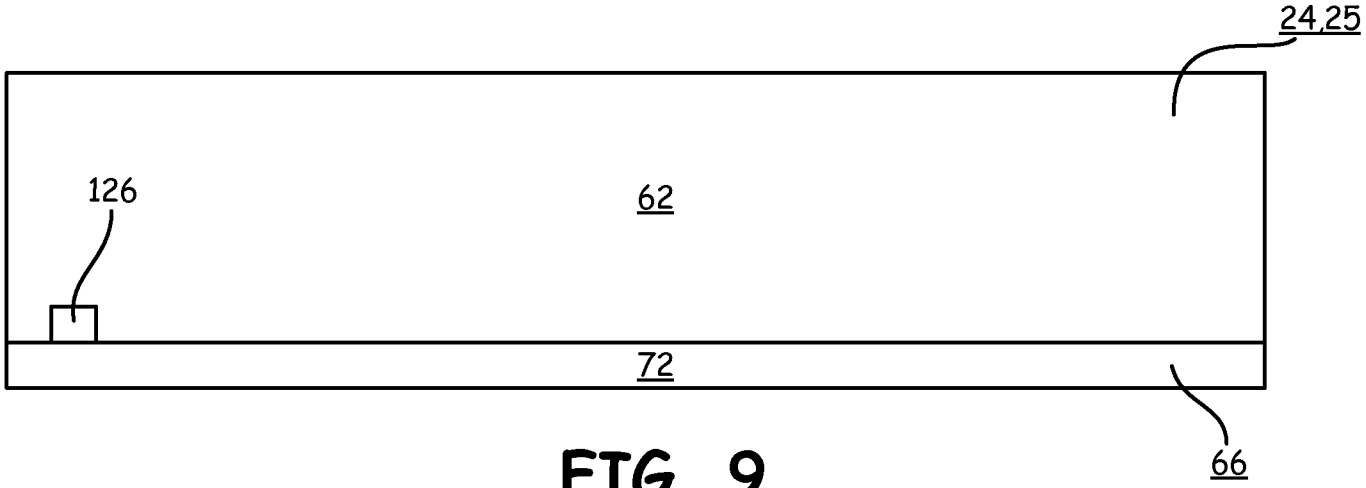
FIG. 9 is a bottom view of the detachable jaw of FIG. 2.

Detachable jaw 24, 25 is shown more clearly in FIGS. 5 and 7. It includes a top edge 60, bottom edge 62, and inner side wall 64. Extending outwardly from inner side wall 64 is dovetailed protrusion rib 66. This protruding rib comprises a substantially flat leading face 68, a tapered top face 70 that slopes inwardly and downwardly towards inner side wall 64, and tapered bottom face 72 that slopes inwardly and upwardly towards inner side wall 64.

This detachable jaw 24, 25 may be made from any suitable material like aluminum, mild steel or other metal, plastic, or wood. If made from a hard metal material like tool steel, it comprises a hard jaw. Such a hard jaw may further include serrations, ribs, grooves, diamond patterns, dovetail, or other protrusions along outward face 63 for enhancing the grip of a pair of opposing hard jaws holding a hard work piece in a tightened vise. These protrusions on the hard jaw surfaces engaging the work piece are unlikely to dent or injure the surface of the hard work piece. If the detachable jaw 24, 25 is made from aluminum, plastic or wood, it is a soft jaw and will normally have a flat outward face 63 that will not dent or mar the surface of a work piece made from a softer material. Moreover, such a soft jaw may have preconfigured into it specially contoured surfaces in the upper portion of the inner side wall 64 for holding the shape of the work piece (not shown).

Figure 11B:
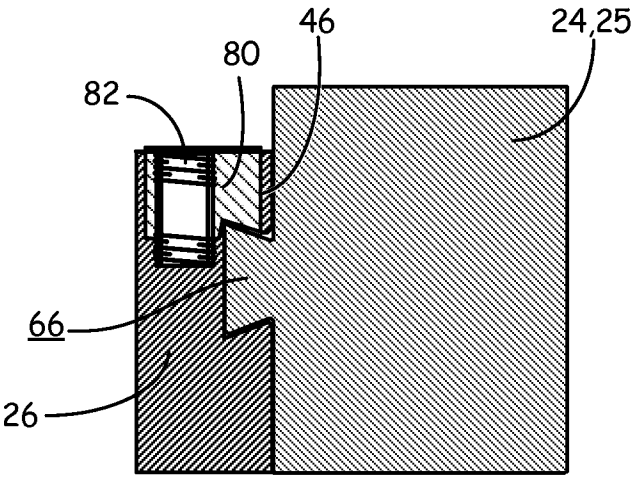
FIG. 11B is a view of FIG. 11A with the stud engaged with the master jaw and hold-down nut with the nut in clamped engagement with the dovetailed protrusion rib of the detachable jaw inserted inside the groove in the master jaw.
Figure 11A:
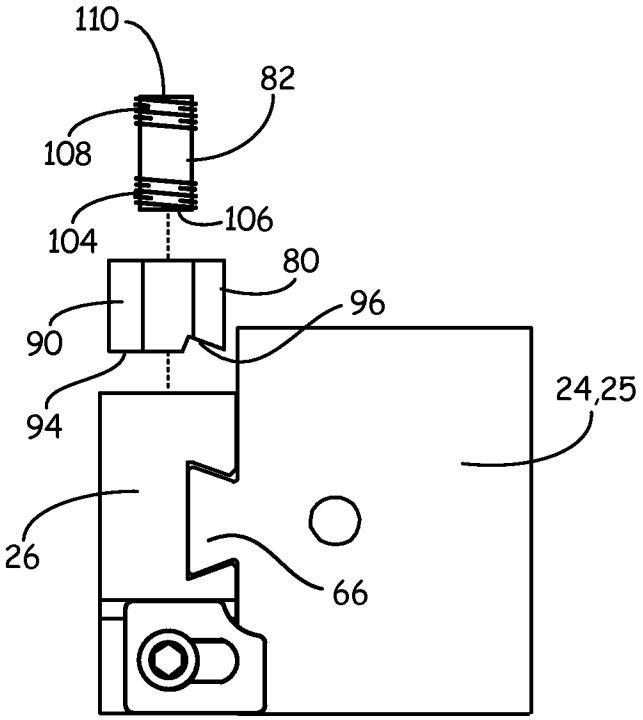
FIG. 11A is a cut-away, exploded view of FIG. 10 taken along lines 11B-11B with the detachable jaw attached to the master jaw.

FIG. 11A shows the master jaw 26 and soft jaw 24, 25 with the protruding rib 66 of the detachable jaw 24,25 inserted into groove 42 of the master jaw. The protruding extension $Z_1$ of rib 66 (see FIG. 5) should be less than the depth $Z_3$ of groove 44 (see FIG. 4*a*), so that upper and lower inner side walls 64 of detachable jaw 24, 25 touches upper and lower inner side walls 46 and 48 of master jaw 26 to provide proper alignment of the detachable jaw with respect to the master jaw. Preferably, distance $Z_1$ for the detachable jaw protruding rib 66 should be only slightly less than distance $Z_3$ for the depth of groove 42 on the master jaw 26 in order to provide stability between the joined detachable jaw and master jaw. In a preferred embodiment of the invention, the protruding extension $Z_1$ of the detachable jaw 24,25 should be about $^{200}/_{1000}$-$^{250}/_{1000}$ inch in length, more preferably closer to $^{250}/_{1000}$ inch in magnitude. Meanwhile, the groove depth $Z_3$ of the master jaw 26 should be about $^{8}/_{1000}$ to $^{20}/_{1000}$ inch greater than the $Z_1$ dimension, more preferably about $^{15}/_{1000}$-$^{20}/_{1000}$ inch greater in measurement.

Tapered bottom face 72 on protruding rib 66 of detachable jaw 24, 25 should have substantially the same slope as the slope of bottom face 52 of groove 42 of master jaw 26. In this manner, when detachable jaw 24, 25 is attached to master jaw 25, the closely mating slopes of these adjacent surfaces of the protruding rib 66 and groove 42 will provide a beneficial level of stability. This angle α for the dovetailed protruding rib 66 of the detachable jaw 24,25 (see FIG. 5) should preferably be about 15-45°, more preferably about 18-22°, even more preferably about 20°. As seen from FIG. 5, as angle α is increased with the length $H_3$ of the front face 68 of the protruding rib 66 remaining the same, then the dimension of the throat 69 joining the protruding rib 66 to the body 61 of the detachable jaw 24,25 will necessarily decrease. This will weaken the detachable jaw. Thus, while larger angles α are possible as long as the angles α in the detachable jaw and bottom face 52 of groove 42 substantially match, more moderately sized angles α around 20° are preferred to enhance the structural stability of the joinder of the detachable jaw to the master jaw.

Because the top surface 50 of groove 42 in master jaw 26 is substantially flat, instead of tapered like other prior art master jaw assembly devices, the detachable jaw 24, 25 of the present invention can be attached or detached from the master jaw in a frontal manner, instead of from the end of the master jaw. The substantially flat top surface 50 will not engage the top tapered surface 70 of protruding rib 66 of the detachable jaw. If the groove 42 in the master jaw 26 were dovetailed with a tapered top surface and tapered bottom surface as is common in the prior art, then the detachable jaw 24, 25 could only be engaged with master jaw 26 from its end so that the dovetailed groove and dovetailed protruding rib match up. Because manufacturing work stations tend to be crowded with other machines or materials, the ability to attach to or detach the detachable jaw 24, 25 from the front of the master jaw 26 is a principal benefit provided by the master jaw assembly 10 of the present invention.

Figure 4:
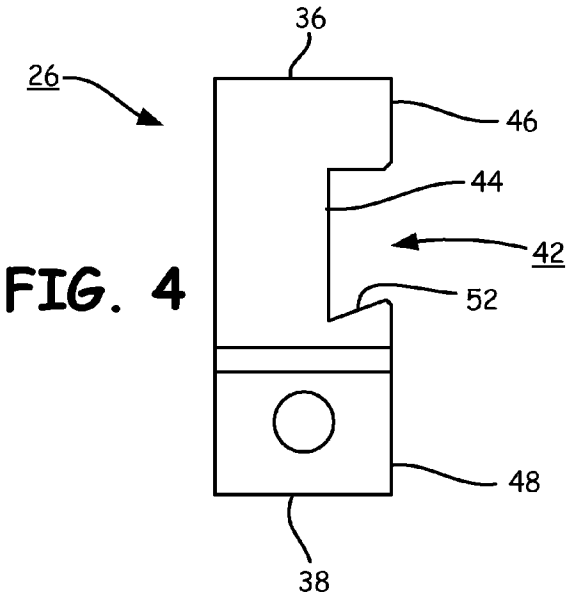
FIGS. 4 and 4*a* are an end view of the master jaw of FIG. 3.
Figure 4A:
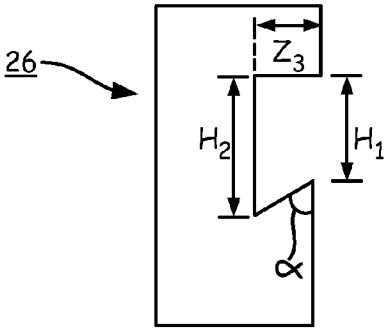

While the height $H_3$ of leading surface 68 of protruding rib 66 may be substantially the same as the height H of groove 42 for dimensional stability between detachable jaw 24, 25 and master jaw 26, in a preferred embodiment the height $H_3$ of the leading surface 68 should be substantially less than the height 1H of the groove in order to make it easier to insert protruding rib 66 into or remove it from groove 42. Referring to FIG. 4*a* and FIG. 5, the height of the opening of groove 42 is defined as $H_1$ while the height of the back wall 44 of the groove 42 is defined as $H_2$. The dimension of $H_2$ will be greater than the dimension of $H_1$. This allows the protruding rib 66 of the detachable jaw 24,25 to be frontally inserted into groove 42 of master jaw 26 by slightly tipping the protruding rib with respect to the groove at the point of entry even if the dimension $H_1$ is similar to the dimension $H_3$ along the front face 68 of the protruding rib. In a preferred embodiment of the present invention, the gap distance $D_1$ between the protruding rib and groove opening (i.e., $H_3-H_1$) should be about $^{65}/_{1000}$-$^{80}/_{1000}$ inch, more preferably about $^{70}/_{1000}$ inch. Meanwhile, the gap distance $D_2$ between the groove opening and groove back wall (i.e., $H_2-H_1$) should be about $^{100}/_{1000}$-$^{110}/_{1000}$ inch, more preferably about $^{95}/_{1000}$ inch. In this manner, greater tolerances between the dimensions of the protruding rib 66 of the detachable jaw 24,25 and groove 42 of the master jaw 26 are permitted, compared against the generally close tolerances required under the prior art. This structural arrangement enhances the frontal insertion of the protruding rib into the groove and removal of it from the groove, while still providing good structural stability of the joinder between the detachable jaw and master jaw.

Figure 10:
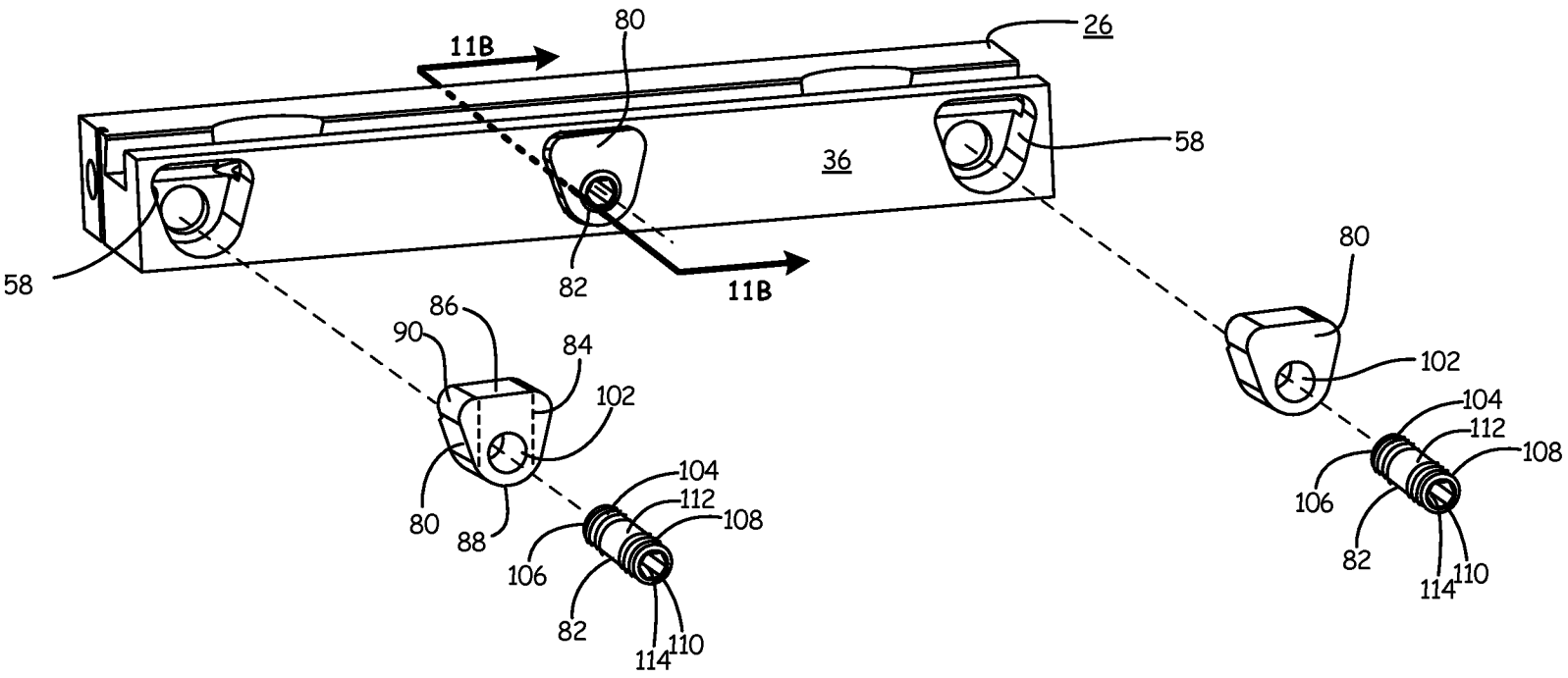
FIG. 10 is an exploded view of the master jaw, hold-down nuts, and double-ended studs.

A clamping means is provided to securely fasten the detachable jaw 24, 25 to master jaw 26. As shown more clearly in FIGS. 10 and 11A, this clamping means comprises a specially shaped hold-down nut 80 and a double-ended stud 82. The hold-down nut 80 has a top face 84 with Side walls 90 extend downwardly from top face 84. These side walls 90 feature a first side edge 86 that is substantially longer than the opposing second side edge portion 88 defined by the perpendicular broken lines shown in FIGS. 10 and 12. These side walls 90 terminate in a bottom face 92 that has a flat surface position 94 near the top base edge 88 of the hold-down nut, and an inwardly and upwardly tapered edge portion 96 near the bottom edge 86.

Tapped bores 100 cut into the perimeter of counter sunk holes 58 in master jaw 26 and tapped bores 102 cut into hold-down nut 80 operatively engage a double-ended stud 82. The stud has a right-handed threaded segment 104 over one end portion 106 thereof, and a left-handed threaded segment 108 over the opposite end portion 110. An unthreaded segment 112 separates the threaded portions 104 and 108 along double-ended stud 82. The stud includes a socket 114 in the upper end 110 to accept an Allen wrench tool.

The hold-down nut 80 operatively engages the left-handed threaded segment 108 of stud 82. The nut holes 58 are sized and shaped to accommodate hold-down nuts 80. The stud 82 can be screwed into bores 100 by the right-handed threads 104 of stud 82.

When the nut 80 operatively engages the stud 82 by means of left-handed threads 108, and the right-handed threads 104 are screwed clockwise into bores 100 of the master jaw 26, the nut will be carried downwardly into the nut holes 58. As shown more clearly in FIG. 11B, when torqued clockwise all the way, the top face 84 of the nut will be flush with the top surface 36 of master jaw 26. Meanwhile, the inwardly and upwardly tapered edge 96 of nut 80 comes into engagement with the top tapered surface 70 of dovetailed protrusion rib 66 of detachable jaw 24, 25 that has already been inserted into groove 42 of master jaw 26.

Tightening the studs 82 further in the clockwise direction places a downward force by the bottom surface of the nut onto the protrusion rib 66 of the detachable jaw 24, 25 to securely clamp the inwardly and upwardly tapered portion face 72 of the protruding rib 66 of the detachable jaw 24, 25 against the inwardly and downwardly tapered bottom face 52 of groove 42 in the master jaw 26 to prevent the detachable jaw from being intentionally or inadvertently detached from the master jaw. Turning the studs 82 in the counterclockwise direction will raise the hold-down nuts 80 to allow the detachable jaw from being detached from the master jaw.

Figure 12:
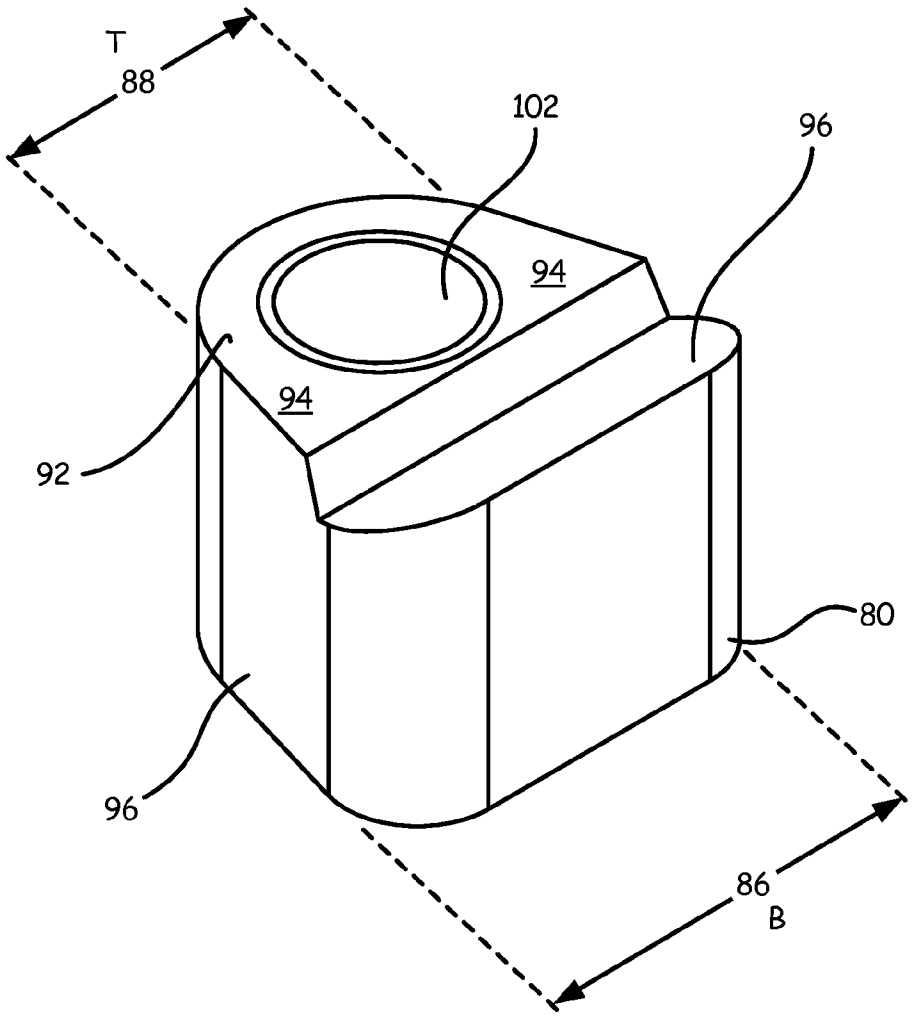
FIG. 12 is an upside-down perspective view of the hold-down nut.

Turning to FIG. 12, the bottom edge distance B of hold-down nut 80 should preferably be about 20-70% greater than the top edge distance T of the hold-down nut, more preferably about 50%. A larger-based hold-down nut could safely be used in the center hole 58 in master jaw 26. But, such a larger-based hold-down nut in the two end holes 58 could interfere with the apertures 56 in the master jaw 26 used by the socket bolts to secure the master jaw to the fixed or movable jaw portion of the vise.

The longer base edge 86 B and consequently longer inwardly and upwardly tapered portion 96 of hold-down nuts 80 provide enhanced clamping force applied by the tightened nut to the protruding rib 66 of the detachable jaw 24, 25. In this manner, the studs 82 do not need to be turned as much in the clockwise direction to clamp the nuts against the dovetailed protruding rib of the detachable jaw to securely attach it to the master jaw. Likewise, the studs do not need to be rotated counterclockwise as much to disengage the nuts from the protruding ribs to allow the detachable jaw to be detached from the master jaw, eased by the gap distance $D_2$ represented by the difference between the height $H_3$ of the protruding rib 66 and height $H_2$ of the groove. This structural arrangement allows the detachable jaw to be adjusted along the length of the master jaw after loosening studs 82 by a quarter turn or less. Two turns or less loosening of studs 82 will typically raise the hold-down nuts 82 sufficiently to allow the detachable jaw 25,25 to be completely removed from master jaw 26.

Figure 13:
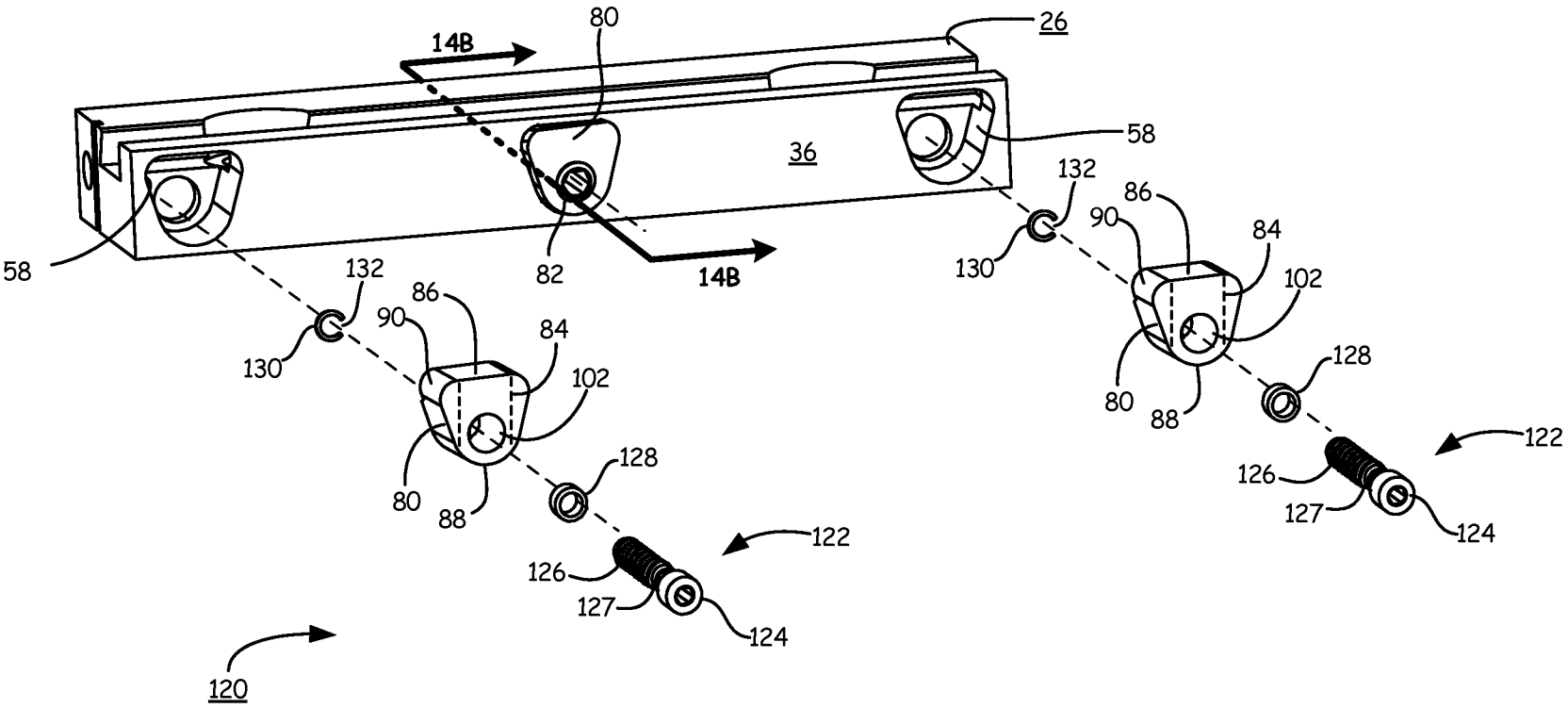
FIG. 13 is an exploded view of the master jaw, hold-down nuts, threaded bolts, and retaining rings.
Figure 14B:
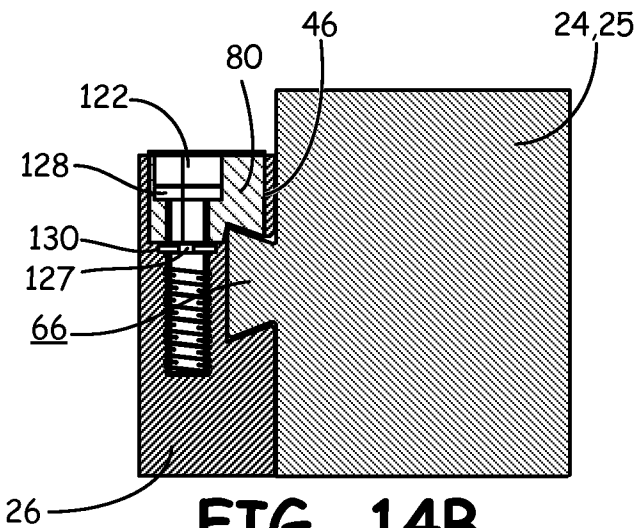
FIG. 14B is a view of FIG. 14A with the threaded bolt engaged with the master jaw and hold-down nut with the nut in combination with the retaining ring in clamped engagement with the dovetailed protrusion rib of the detachable jaw inserted inside the groove in the master jaw.
Figure 14A:
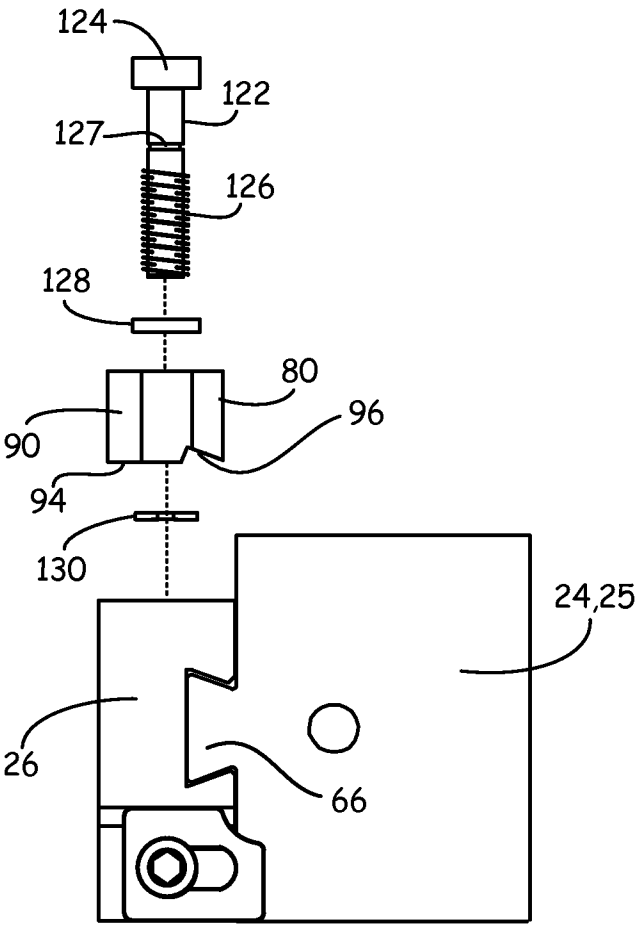
FIG. 14A is a cut-away, exploded view of FIG. 13 taken along lines 14B-14B with the detachable jaw attached to the master jaw.

A second embodiment of the clamping means assembly 120 of the present invention is shown in FIG. 13. Instead of employing the double ended stud 82 with left-hand and right-hand threads at opposite ends for jacking the hold-down nut 80 up and down when counter-rotated and rotated, respectively, with respect to the master jaw 26, a conventional threaded bolt 122 having a bolt head 124 and threaded shank portion 126 is used in combination with a washer 128, and a retaining ring 130. As shown in FIGS. 13 and 14A and 14B, the washer 128 is positioned between the bolt head 124 and the hold-down nut 80. The threaded shank portion 126 of the bolt 122 is screwed through the tapped bore in the hold-down nut 80 into threaded engagement with the tapped bore 102 in the master jaw 26.

Figure 15:
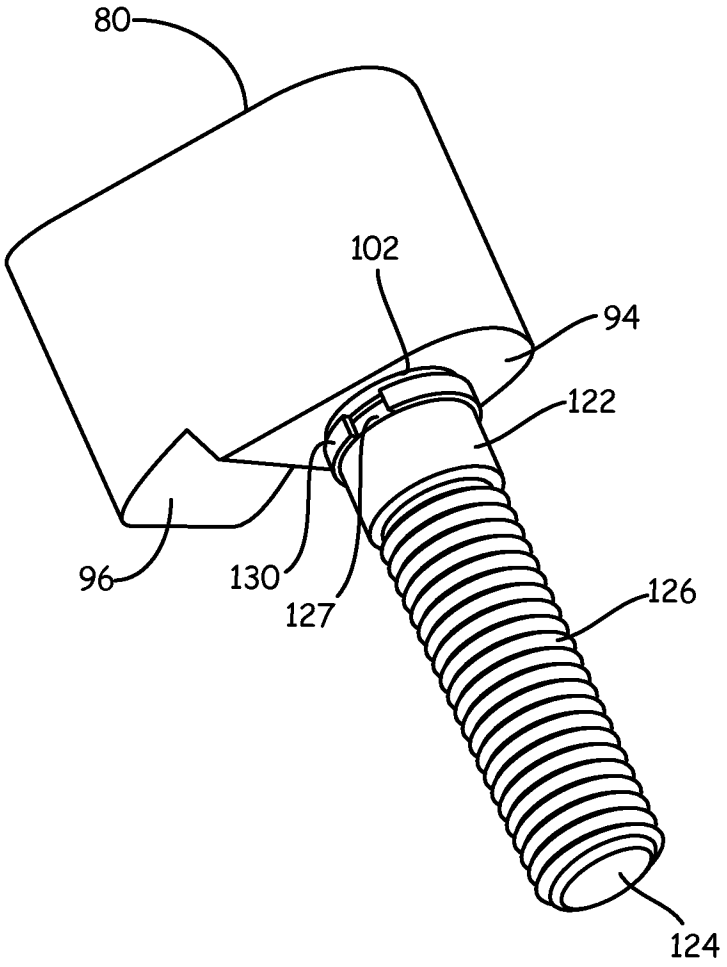
FIG. 15 is a perspective view of the threaded bolt inserted through hold-down nut with the retaining ring secured to the shank of the threaded bolt.

The retaining ring 130 is "C" shaped with an opening 132, so that it can be inserted laterally around an annular niche 127 formed around the unthreaded portion of the shank of threaded bolt 122 (see FIG. 15). Retaining ring 130 is disposed against the bottom surface of hold-down nut 80. The tapped bore in the hold-down nut should have an enlarged well 134 in its upper region for accommodating holt head 124 of bolt 122 and washer 128, so that when threaded bolt 122 is screwed into engagement with master jaw 26, the top of bolt head 124 is roughly co-planar with the top surface of the master jaw. Similarly, the counter bore in master jaw 26 should have a slightly enlarged well for accommodating retaining ring 130, so that hold-down nut 80 can smoothly be lowered inside the counter bore.

As shown in FIG. 14B, when the bolt 122 is rotated in a clockwise direction by means of an Allen wrench inserted into a socket in the bolt head 124, it will act to move the hold-down nut 80 down into the master jaw 26, so that the inwardly and upwardly tapered bottom face portion 96 of the nut engages the top inclined surface 70 of the dovetail protrusion inside the groove of the master jaw to secure the detachable jaw 24,25 to the master jaw 26. Washer 128 will bear against the bottom surface of a well 134 machined into the tapped bore in the hold-down nut to more efficiently apply the force applied by the bolt 122 to the hold-down nut. But, when the bolt 122 is turned in the counter-clockwise direction, the retaining ring 130 securably attached inside annular niche 127 around the unthreaded portion of the bolt shank will come into contact with the bottom surface of the hold-down nut to pull the hold-down nut 80 upwards away from the dovetail protrusion as the bolt continues to turn. In this manner, the detachable jaw 24,25 may be removed from the master jaw 26, or moved longitudinally with respect to the master jaw.

Unless a work job at a manufacturing facility will be completed on a one-time, batch basis, it may be necessary to reinstall a detachable jaw 24, 25 for a particular job in attached relationship with the master jaw 26 to resume the job. It is important to make sure that the detachable jaw has been correctly aligned with respect to the master jaw, or else the machine tool 14 may not perform its operation in the correct location on the work piece 16. In the case of FIG. 1, for example, the drill bit 14 may drill holes 18 in the wrong spots on the metal block work piece 16. This is particularly important for soft jaws that have specially contoured surfaces for holding the work piece in a predetermined special alignment with the preprogrammed machine tool.

Referring to FIG. 1, it is relatively easy to ensure proper alignment of the detachable jaw 24, 25 with respect to the master jaw 26 along the Z-axis by ensuring that the bottom surfaces of the detachable jaw and master jaw abut a common planar backing surface. Protruding rib 66 inserted into groove 42 and tightened hold-down nuts 80 will assist with this Z-axis alignment. Likewise, alignment of the detachable jaw and master jaw along the Y-axis is greatly enhanced by the operator making sure that the opposing surfaces of the detachable jaw and master jaw abut each other when the two pieces are attached to each other.

However, it is considerably more difficult to correctly align the detachable jaw with the master jaw along the X-axis, since there is no structural reference point. Misalignment along the X-axis can easily cause the machine tool 14 to drill the holes 18 too far to the left or right in the metal black work pieces 16.

This alignment means is provided by reference stop plate 120 which is attached to one or both ends of master jaw 26, as shown in FIGS. 2-3. Reference stop plate 120 can be removably attached to the end of the master jaw by any suitable means like screws or bolts. Preferably, reference stop plate 120 bears oval-shaped aperture 122 with retaining bolt 124 with a socket head passing through the aperture to attach the reference stop plate 120 to the master jaw. Because of the elongated shape of aperture 122, the reference stop plate can be moved along the B-axis (see FIG. 3) to extend beyond lower face 48 of the master jaw in its engaged position, or moved in the other direction along the B-axis to the disengaged position that does not project beyond face 48. Alternatively, reference stop plate 120 can be pivoted from an engaged position along the B-axis to a disengaged position along the C-axis.

When in its engaged position, reference stop plate 120 can abut the end of detachable jaw 24, 25 so that it is correctly aligned, when attached to master jaw 26 with the end of the master jaw. If a soft jaw had its contoured surface prepared for holding the work piece 16 positioned with respect to the machine tool's position with the ends of the soft jaw and master jaw in co-planar relationship, then this reference stop plate 120 enables the soft jaw to be readily reattached to the master jaw with proper alignment along the A-axis (X-axis in FIG. 1). For soft jaws that are longer than the master jaw, the soft jaw may be equipped with a niche 126 formed in, e.g., its bottom surface for receiving the extended reference stop plate 120. This will readily enable the correct alignment of the elongated soft jaw attached to the master jaw.

The above specification, drawings, and data provide a complete description of the master jaw assembly of the present invention. Since many embodiments of the invention can be made without departing from the spirit and scope of the invention, the invention resides in the claims hereinafter appended.

I claim:

1. A jaw assembly used in a vise, comprising:

(a) a vise jaw having a groove extending along an inner side surface of the vise jaw, the groove having a base wall defined by a top and bottom opposed walls where the top wall is approximately normal to the base wall, and the bottom wall is tapered inwardly and downwardly towards the base wall, and with at least one threaded aperture formed inwardly from a top surface of the vise jaw terminating in a vertically-positioned tapped hole intersecting the top wall portion of the vise jaw;

(b) a detachable jaw having a top edge and a parallel bottom edge, a dovetailed protruding rib extending from an inner side surface of the detachable jaw, the detachable jaw being mounted on the vise jaw by insertion of the protruding rib of the detachable jaw inside the groove of the vise jaw;

(c) at least one nut having a top surface and a threaded bore running longitudinally through a body of the nut, and an inwardly and upwardly tapered edge in a bottom surface of the nut, wherein the aperture in the vise jaw is sized and shaped to receive the nut therein, and wherein the top and bottom faces of the nut have a first edge that is substantially longer than the opposing second edge;

(d) at least one threaded fastener having at least one threaded segment for screwing into the threaded bore in the vise jaw and into the threaded bore in the nut;

(e) wherein when the threaded fastener is rotated clockwise, the first end of the threaded fastener screws into the threaded bore in the vise jaw and draws the nut downward through the aperture in the vise jaw and thereby clamps the dovetail protruding rib of the detachable jaw between the bottom face of the groove of the vise jaw and the tapered edge in the bottom surface of the nut with the elongated first edge of the nut enhancing the transfer of clamping force from the nut to the protruding rib of the detachable jaw;

(f) wherein when the threaded fastener is rotated counter-clockwise, the threaded fastener screws into the threaded bore in the vise jaw and draws the nut upwards through the aperture in the vise jaw and thereby removes the clamping of the dovetail protruding rib of the detachable jaw between the bottom face of the groove of the vise jaw and the tapered edge in the bottom surface of the nut; and (g) further comprising an adjustable reference stop plate movably attached to a first end of the vise jaw that may be moved between an engaged position extending beyond the inner side surface of the vise jaw, and a disengaged position that does not extend beyond the inner side surface of the vise jaw, wherein when the reference stop plate is in its engaged position, and the detachable jaw is attached to the vise jaw, the reference stop plate abuts an end of the detachable jaw or a niche formed at an intermediate location within a side of the detachable jaw to properly orient the attached detachable jaw along a longitudinal axis of the vise jaw.

2. The vise jaw assembly of claim 1, wherein a second adjustable reference stop plate movably attached to a second end of the vise jaw that may be moved between an engaged position extending beyond the inner side surface of the vise jaw, and a disengaged position that does not extend beyond the inner side surface of the vise jaw, wherein when the reference stop plate is in its engaged position, and the detachable jaw is attached to the vise jaw, the reference stop plate abuts an end of the detachable jaw or a niche formed at an intermediate location within a side of the detachable jaw to properly orient the attached detachable jaw along a longitudinal axis of the vise jaw.

3. The vise jaw assembly of claim 2, wherein two or more detachable jaws can be mounted on the vise jaw in end-to-end relation.

4. The vise jaw assembly of claim 1 wherein:

(a) the threaded fastener comprises a double ended stud having a right-hand threaded segment at its first end for screwing into the threaded bore in the vise jaw, and a left-hand threaded segment at the second end of the fastener for screwing into the threaded bore in the nut;

(b) when the double-ended stud is rotated clockwise, the first end of the double-ended stud screws into the threaded bore in the vise jaw and draws the nut downward through the aperture in the vise jaw and thereby clamps the dovetail protruding rib of the detachable jaw between the bottom face of the groove of the vise jaw and the tapered edge in the bottom surface of the nut with the elongated first edge of the nut enhancing the transfer of clamping force from the nut to the protruding rib of the detachable jaw; and (c) when the double-ended stud is rotated counter-clockwise, the first end of the double-ended stud screws into the threaded bore in the vise jaw and draws the nut upwards through the aperture in the vise jaw and thereby removes the clamping of the dovetail protruding rib of the detachable jaw between the bottom face of the groove of the vise jaw and the tapered edge in the bottom surface of the nut.

5. The vise jaw assembly of claim 1 further comprising an aperture having an oblong shape formed in the adjustable reference stop plate through which a fastener passes to attach the adjustable reference stop plate to the end of the vise jaw, wherein the vise jaw has a horizontal axis, and the adjustable reference stop plate can be slideably adjusted along the horizontal axis between its disengaged position and its engagement position.

6. The vise jaw assembly of claim 1, wherein:

(a) the threaded fastener comprises a double ended stud having a right-hand threaded segment at its first end for screwing into the threaded bore in the vise jaw, and a left-hand threaded segment at the second end of the fastener for screwing into the threaded bore in the nut;

(b) when the double-ended stud is rotated clockwise, the first end of the double-ended stud screws into the threaded bore in the vise jaw and draws the nut downward through the aperture in the vise jaw and thereby clamps the dovetail protruding rib of the detachable jaw between the bottom face of the groove of the vise jaw and the tapered edge in the bottom surface of the nut with the elongated first edge of the nut enhancing the transfer of clamping force from the nut to the protruding rib of the detachable jaw; and (c) when the double-ended stud is rotated counter-clockwise, the first end of the double-ended stud screws into the threaded bore in the vise jaw and draws the nut upwards through the aperture in the vise jaw and thereby removes the clamping of the dovetail protruding rib of the detachable jaw between the bottom face of the groove of the vise jaw and the tapered edge in the bottom surface of the nut.

7. The vise jaw assembly of claim 1 further comprising a difference between a height $H_3$ along the dovetail protruding rib of the detachable jaw, and a height $H_1$ along a front face of the groove of the vise jaw, so that when the dovetail protruding rib of the detachable jaw is inserted into the groove of the vise jaw, this difference produces a gap that makes it easier to attach the detachable jaw to or remove it from the vise jaw without having to make as many rotational turns to the double-ended stud of the clamping nut.

8. The vise jaw assembly of claim 1 further comprising a difference between a height $H_1$ along a front face of the groove of the vise jaw and a height $H_2$ along the back wall of the groove, so that when the dovetail protruding rib of the detachable jaw is inserted into the groove of the vise jaw, this difference produces a gap that makes it easier to attach the detachable jaw to or remove it from the vise jaw without having to make as many rotational turns to the double-ended stud of the clamping nut.

9. A master jaw assembly used in a vice, comprising:

(a) a master jaw having a groove extending along an inner side surface of the master jaw, the groove having a base wall defined by a top and bottom opposed walls where the top wall is approximately normal to the base wall, and the bottom wall is tapered inwardly and downwardly towards the base wall, and with at least one threaded aperture formed inwardly from a top surface of the master jaw terminating in a vertically-positioned tapped hole intersecting the top wall portion of the master jaw;

(b) a detachable jaw having a dovetailed protruding rib extending from an inner side surface of the detachable jaw, the detachable jaw being mounted on the master jaw by insertion of the protruding rib of the detachable jaw inside the groove of the master jaw;

(c) at least one nut having a top surface and a threaded bore running longitudinally through a body of the nut, and an inwardly and upwardly tapered edge in a bottom surface of the nut, wherein the aperture in the master jaw is sized and shaped to receive the nut therein, and wherein the top and bottom faces of the nut have a first edge that is substantially longer than the opposing second edge;

(d) at least one threaded fastener having at least one threaded segment for screwing into the threaded bore in the master jaw and into the threaded bore in the nut;

(e) wherein when the threaded fastener is rotated clockwise, the first end of the threaded fastener screws into the threaded bore in the master jaw and draws the nut downward through the aperture in the master jaw and thereby clamps the dovetail protruding rib of the detachable jaw between the bottom face of the groove of the master jaw and the tapered edge in the bottom surface of the nut with the elongated first edge of the nut enhancing the transfer of clamping force from the nut to the protruding rib of the detachable jaw;

(f) wherein when the threaded fastener is rotated counterclockwise, the threaded fastener screws into the threaded bore in the master jaw and draws the nut upwards through the aperture in the master jaw and thereby removes the clamping of the dovetail protruding rib of the detachable jaw between the bottom face of the groove of the master jaw and the tapered edge in the bottom surface of the nut; and (g) An adjustable reference stop plate movably attached to an end of the master jaw that may be moved between an engaged position extending beyond the inner side surface of the master jaw, and a disengaged position that does not extend beyond the inner side surface of the master jaw, wherein when the reference stop plate is in its engaged position, and the detachable jaw is attached to the master jaw, the reference stop plate abuts an end of the detachable jaw or a niche formed at an intermediate location within a side of the detachable jaw to properly orient the attached detachable jaw along a longitudinal axis of the master jaw.

10. The master jaw assembly of claim 9 further comprising an aperture formed in the adjustable reference stop plate through which a fastener passes to attach the adjustable reference stop plate to the end of the master jaw, wherein the master jaw has a vertical axis and a horizontal axis normal to the vertical axis, and the adjustable reference stop plate can be rotated from a disengaged position along the vertical axis to an engagement position along the horizontal axis.

11. The master jaw assembly of claim 9 further comprising an aperture having an oblong shape formed in the adjustable reference stop plate through which a fastener passes to attach the adjustable reference stop plate to the end of the master jaw, wherein the master jaw has a horizontal axis, and the adjustable reference stop plate can be slideably adjusted along the horizontal axis between its disengaged position and its engagement position.

12. A master jaw assembly used in a vice, comprising:

(a) a master jaw having a groove extending along an inner side surface of the master jaw, the groove having a base wall defined by a top and bottom opposed walls where the top wall is approximately normal to the base wall, and the bottom wall is tapered inwardly and downwardly towards the base wall, and with at least one aperture formed inwardly from a top surface of the master jaw terminating in a vertically-positioned tapped hole intersecting the top wall portion of the master jaw;

(b) a detachable jaw having a dovetailed protruding rib extending from an inner side surface of the detachable jaw, the detachable jaw being mounted on the master jaw by insertion of the protruding rib of the detachable jaw inside the groove of the master jaw;

(c) at least one nut having a top surface and a threaded bore running longitudinally through a body of the nut, and an inwardly and upwardly tapered edge in a bottom surface of the nut, wherein the aperture in the master jaw is sized and shaped to receive the nut therein;

(d) at least one threaded fastener having at least one threaded segment for screwing into the threaded bore in the master jaw, and into the threaded bore in the nut;

(e) wherein when the threaded fastener is rotated clockwise, the first end of the threaded fastener screws into the threaded bore in the master jaw and draws the nut downward through the aperture in the master jaw and thereby clamps the dovetail protruding rib of the detachable jaw between the bottom face of the groove of the master jaw and the tapered edge in the bottom surface of the nut;

(f) wherein when the threaded fastener is rotated counterclockwise, the threaded fastener screws into the threaded bore in the master jaw and draws the nut upwards through the aperture in the master jaw and thereby removes the clamping of the dovetail protruding rib of the detachable jaw between the bottom face of the groove of the master jaw and the tapered edge in the bottom surface of the nut;

(g) an adjustable reference stop plate movably attached to an end of the master jaw that may be moved between an engaged position extending beyond the inner side surface of the master jaw, and a disengaged position that does not extend beyond the inner side surface of the master jaw; and (h) wherein when the reference stop plate is in its engaged position, and the detachable jaw is attached to the master jaw, the reference stop plate abuts an end of the detachable jaw or a niche formed at an intermediate location within a side of the detachable jaw to properly orient the attached detachable jaw along a longitudinal axis of the master jaw.

13. The master jaw assembly of claim 12, wherein:

(a) the threaded fastener comprises a double ended stud having a right-hand threaded segment at its first end for screwing into the threaded bore in the master jaw, and a left-hand threaded segment at the second end of the fastener for screwing into the threaded bore in the nut;

(b) when the double-ended stud is rotated clockwise, the first end of the double-ended stud screws into the threaded bore in the master jaw and draws the nut downward through the aperture in the master jaw and thereby clamps the dovetail protruding rib of the detachable jaw between the bottom face of the groove of the master jaw and the tapered edge in the bottom surface of the nut with the elongated first edge of the nut enhancing the transfer of clamping force from the nut to the protruding rib of the detachable jaw; and (c) when the double-ended stud is rotated counter-clockwise, the first end of the double-ended stud screws into the threaded bore in the master jaw and draws the nut upwards through the aperture in the master jaw and thereby removes the clamping of the dovetail protruding rib of the detachable jaw between the bottom face of the groove of the master jaw and the tapered edge in the bottom surface of the nut.

14. The master jaw assembly of claim 12, wherein:

(a) the threaded fastener comprises a threaded bolt having a bolt head at its first end and a threaded segment along a shank at its second end for screwing into the threaded bore in the master jaw and into the threaded bore in the nut;

(b) when the threaded bolt is rotated clockwise, the threaded segment screws into the threaded bore in the master jaw and draws the nut downward through the aperture in the master jaw and thereby clamps the dovetail protruding rib of the detachable jaw between the bottom face of the groove of the master jaw and the tapered edge in the bottom surface of the nut with the elongated first edge of the nut enhancing the transfer of clamping force from the nut to the protruding rib of the detachable jaw; and (c) when the threaded fastener is rotated counter-clockwise, the threaded segment screws into the threaded bore in the master jaw, and a retaining ring interposed around the shank of the threaded fastener adjacent to the bottom surface of the nut bears against the bottom surface of the nut as the threaded fastener turns to draw the nut upwards through the aperture in the master jaw as the fastener turns, and thereby removes the clamping of the dovetail protruding rib of the detachable jaw between the bottom face of the groove of the master jaw and the tapered edge in the bottom surface of the nut.

15. The master jaw assembly of claim 14 further comprising a washer interposed around the threaded segment of the threaded fastener between the bolt head and the top surface of the nut to apply the force of the threaded fastener turned in the clockwise direction to the top surface of the nut.

16. The master jaw assembly of claim 12 further comprising an aperture formed in the adjustable reference stop plate through which a fastener passes to attach the adjustable reference stop plate to the end of the master jaw, wherein the master jaw has a vertical axis and a horizontal axis normal to the vertical axis, and the adjustable reference stop plate can be rotated from a disengaged position along the vertical axis to an engagement position along the horizontal axis.

17. The master jaw assembly of claim 16, wherein the angle $\alpha$ between the dovetailed protruding rib and body of the detachable jaw is about 20°.

18. The master jaw assembly of claim 12 further comprising an aperture having an oblong shape formed in the adjustable reference stop plate through which a fastener passes to attach the adjustable reference stop plate to the end of the master jaw, wherein the master jaw has a horizontal axis, and the adjustable reference stop plate can be slideably adjusted along the horizontal axis between its disengaged position and its engagement position.

19. The master jaw assembly of claim 12 further comprising a difference between a height $H_3$ along the dovetail protruding rib of the detachable jaw, and a height $H_1$ along a front face of the groove of the master jaw, so that when the dovetail protruding rib of the detachable jaw is inserted into the groove of the master jaw, this difference produces a gap that makes it easier to attach the detachable jaw to or remove it from the master jaw without having to make as many rotational turns to the double-ended stud of the clamping nut.

20. The master jaw assembly of claim 19, wherein the gap difference between the height $H_3$ along the dovetail protruding rib of the detachable jaw, and the height $H_1$ along the front face of the groove of the master jaw is about $^{65}/_{1000}$-$^{80}/_{1000}$ inch.

21. The master jaw assembly of claim 20, wherein the gap difference between the height $H_3$ along the dovetail protruding rib of the detachable jaw, and the height $H_1$ along the front face of the groove of the master jaw is about $^{70}/_{1000}$ inch.

22. The master jaw assembly of claim 12 further comprising a difference between a height $H_1$ along a front face of the groove of the master jaw and a height $H_2$ along the back wall of the groove, so that when the dovetail protruding rib of the detachable jaw is inserted into the groove of the master jaw, this difference produces a gap that makes it easier to attach the detachable jaw to or remove it from the master jaw without having to make as many rotational turns to the double-ended stud of the clamping nut.

23. The master jaw assembly of claim 22, wherein the gap difference between the height $H_1$ along the a front face of the groove of the master jaw and a height $H_2$ along the back wall of the groove of the groove of the master jaw is about $^{100}/_{1000}$-$^{110}/_{1000}$ inch.

24. The master jaw assembly of claim 23, wherein the gap difference between the height $H_1$ along the a front face of the groove of the master jaw and a height $H_2$ along the back wall of the groove of the groove of the master jaw is about $^{95}/_{1000}$ inch.

25. The master jaw assembly of claim 12, wherein the angle $\alpha$ between the dovetailed protruding rib and body of the detachable jaw is about 15-45°.

26. The master jaw assembly of claim 12 further comprising computer numeric control-operated machine tool used in association with a work piece held in position between a pair of detachable jaws secured to respective master jaws secured respectively to the vice, the machine tool being programmed to be automatically positioned in a spot along a horizontal axis, a vertical axis, and a third axis running between the machine tool and the work piece, wherein the detachable jaws can be repeatably and reliably attached to their master jaws in substantially the same position with respect to the horizontal axis, vertical axis, and third axis.

27. The master jaw assembly of claim 26, wherein the machine tool comprises a drill, saw, lathe, milling machine, wood router, laser cutter, plasma cutter, water jet cutter, surface grinder, cylindrical grinder, knife cutter, glass cutter, embroidery needle, sheet metal punch, wire bender, hot-wire foam cutter, or other tool that performs a work operation upon the work piece.

28. The master jaw assembly of claim 12, wherein the work piece is an object made from metal, wood, plastic, glass, fabric, foam, or other useful material that is in the process of manufacture to produce an end product.

* * * * *